US007458352B2

(12) United States Patent
Sailer et al.

(10) Patent No.: US 7,458,352 B2
(45) Date of Patent: Dec. 2, 2008

(54) SWITCHABLE VALVE DRIVE ELEMENT OF AN INTERNAL COMBUSTION ENGINE

(75) Inventors: Peter Sailer, Erlangen (DE); Oliver Schnell, Veitsbronn (DE); Jochen Tovar, Erlangen (DE)

(73) Assignee: INA Schaeffler KG (DE)

( * ) Notice: Subject to any disclaimer, the term of this patent is extended or adjusted under 35 U.S.C. 154(b) by 0 days.

(21) Appl. No.: 11/186,331

(22) Filed: Jul. 21, 2005

(65) Prior Publication Data

US 2006/0027193 A1 Feb. 9, 2006

(30) Foreign Application Priority Data

Aug. 7, 2004 (DE) ..... 10 2004 038 446

(51) Int. Cl.
*F01L 1/14* (2006.01)

(52) U.S. Cl. ..... 123/90.55; 123/90.48; 123/90.5; 123/90.52; 123/90.57; 123/198 F

(58) Field of Classification Search ..... 123/90.55
See application file for complete search history.

(56) References Cited

U.S. PATENT DOCUMENTS 3,838,669 A * 10/1974 Dadd ..... 123/90.35
3,921,609 A * 11/1975 Rhoads ..... 123/90.55
6,497,207 B2 12/2002 Spath et al. ..... 123/90.16
6,584,942 B1 7/2003 Albertson et al. ..... 123/90.16
6,688,266 B1 2/2004 Church et al. ..... 123/90.16
6,802,288 B2 * 10/2004 Spath ..... 123/90.16
6,805,085 B2 * 10/2004 Kuhl et al. ..... 123/90.57
2003/0005897 A1 * 1/2003 Kuhl et al. ..... 123/90.12

FOREIGN PATENT DOCUMENTS

DE 101 09 954 A1 9/2002
DE 101 19 366 A1 10/2002
DE 102 12 522 A1 10/2003
DE 600 08 936 T2 8/2004

OTHER PUBLICATIONS

German Search Report 10 2004 038 446.0dated Mar. 30, 2005.

* cited by examiner

*Primary Examiner*—Thomas E Denion
*Assistant Examiner*—Kyle M Riddle
(74) *Attorney, Agent, or Firm*—Ostrolenk, Faber, Gerb & Soffen, LLP

(57) ABSTRACT

A switchable valve drive element of an internal combustion engine can be actuated hydraulically. A valve tappet which can be displaced axially in a bore of the machine housing by the cam of a camshaft. A switching duct adjoins the valve tappet and is filled with a hydraulic oil. A connection on the valve drive element between the switching duct and a space with a lower pressure level compared to the pressure in the switching duct. The connection can be produced between the switching duct and the space with a lower pressure level by means of the valve tappet. The space may be inside the tappet.

4 Claims, 2 Drawing Sheets

SWITCHABLE VALVE DRIVE ELEMENT OF AN INTERNAL COMBUSTION ENGINE

FIELD OF THE INVENTION

The invention relates to a switchable valve drive element of an internal combustion engine, which can be actuated hydraulically. The valve drive element has a valve tappet which can be displaced axially in a bore of the machine housing by the cam of a camshaft. A switching duct adjoins the valve tappet and is filled with a hydraulic oil.

BACKGROUND OF THE INVENTION

DE 102 12 522 A1 discloses using a rotation prevention bridge for preventing rotation of a plurality of valve drive elements of an internal combustion engine and as an aid for mounting them, whenever the valve drive element is secured in the rotation prevention bridge. A valve drive element of the type mentioned at the beginning is known, for example, from U.S. Pat. No. 6,497,207, incorporated herein by reference. With such switchable valve tappets which operate with hydraulic oil, it is possible for air to collect in the switching duct which is filled with oil. This presents the risk of the switching processes varying when pressure is built up and reduced, that is of their no longer having a uniform profile.

SUMMARY OF THE INVENTION

The invention is based on the object of developing the valve drive element in such a way that variations in the switching behavior are reliably avoided.

This object is achieved according to the invention. A connection is formed on the valve drive element between the switching duct and a space with a lower pressure level compared to the pressure in the switching duct. In this context, the connection between the switching duct and the space with a lower pressure level can be formed by the valve tappet.

In this way, air and/or foamed hydraulic oil are rinsed out of the switching duct so that they cannot bring about any variations in the switching behavior and the object of the invention is thus achieved. The connection between the switching duct and the space with a lower pressure level must be configured such that the reaction time of the switching process is not influenced, or is only influenced insignificantly. Since this is achieved in the invention by the movement of the valve tappet itself, the switching duct is scavenged only during a few angle degrees of the cam.

In order to produce the connection from the switching duct to the space with a lower pressure level, a longitudinal groove may be arranged on the outer face of the valve tappet. That groove is connected via a scavenging duct, for example a radial bore, to an interior space of the valve tappet. In this context, an overflow point which permits air and/or foamed hydraulic oil to flow out of the switching duct may be formed at one end of the longitudinal groove.

Other features and advantages of the present invention will become apparent from the following description of the invention which refers to the accompanying drawings.

BRIEF DESCRIPTION OF THE DRAWING(S)

An exemplary embodiment of the invention is illustrated in the drawing and is described below.

DETAILED DESCRIPTION OF EMBODIMENTS OF THE INVENTION

Figure 1:
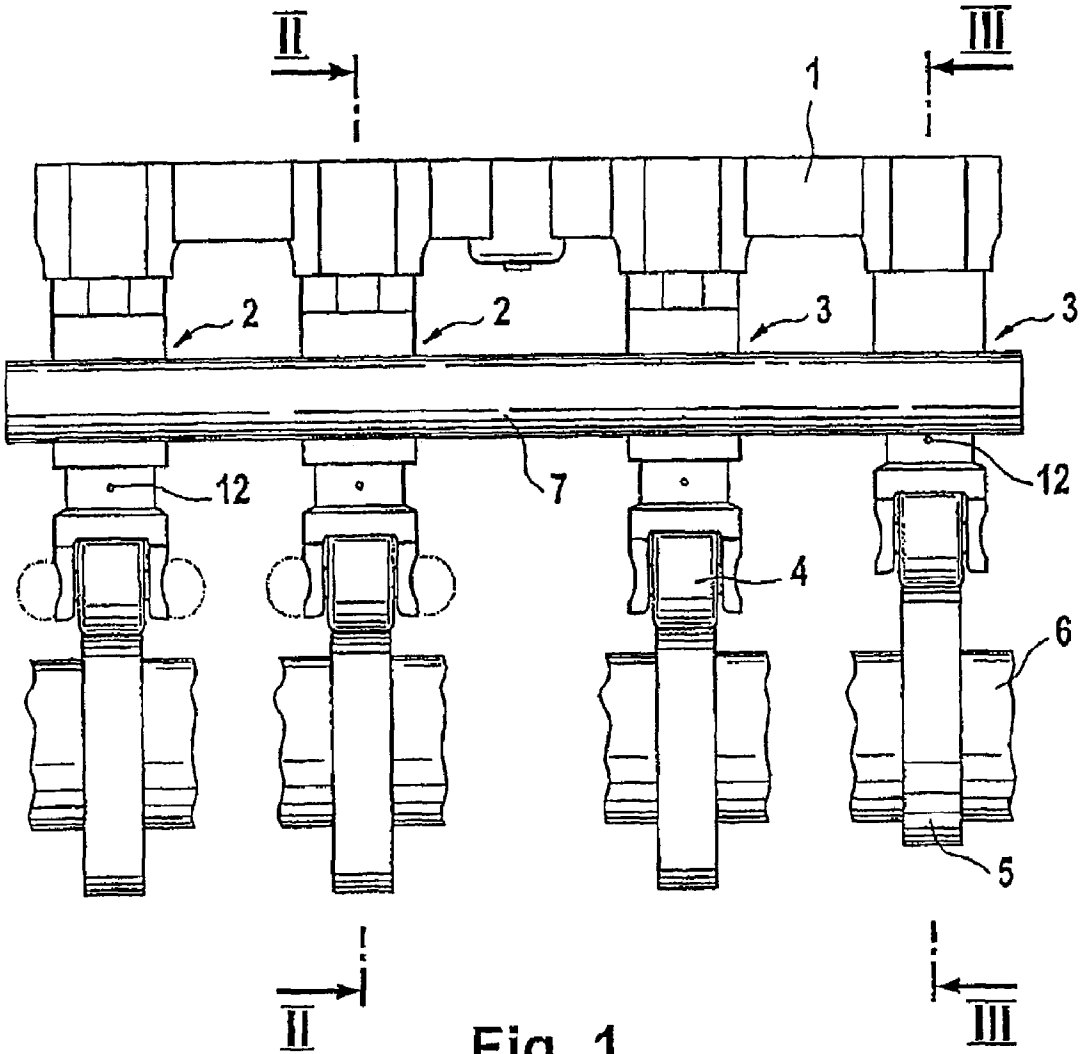
FIG. 1 is a side view of a rotation prevention bridge with four valve drive elements which are supported on cams of a camshaft and have a common switching duct.

A rotation prevention bridge 1 illustrated in FIG. 1 has four receptacle spaces which are arranged spaced apart one after the other. A valve drive element 2 or 3 is plugged in at one end thereof into each receptacle space. At its other end, each valve drive element 2 or 3 has a respective roller 4 which is mounted with roller bearings. The roller 4 supports its valve drive element 2 or 3 on a cam 5 of a camshaft 6 that extends in the longitudinal direction. All four valve drive elements 2 and 3 are connected to a common switching duct 7.

Figure 4:
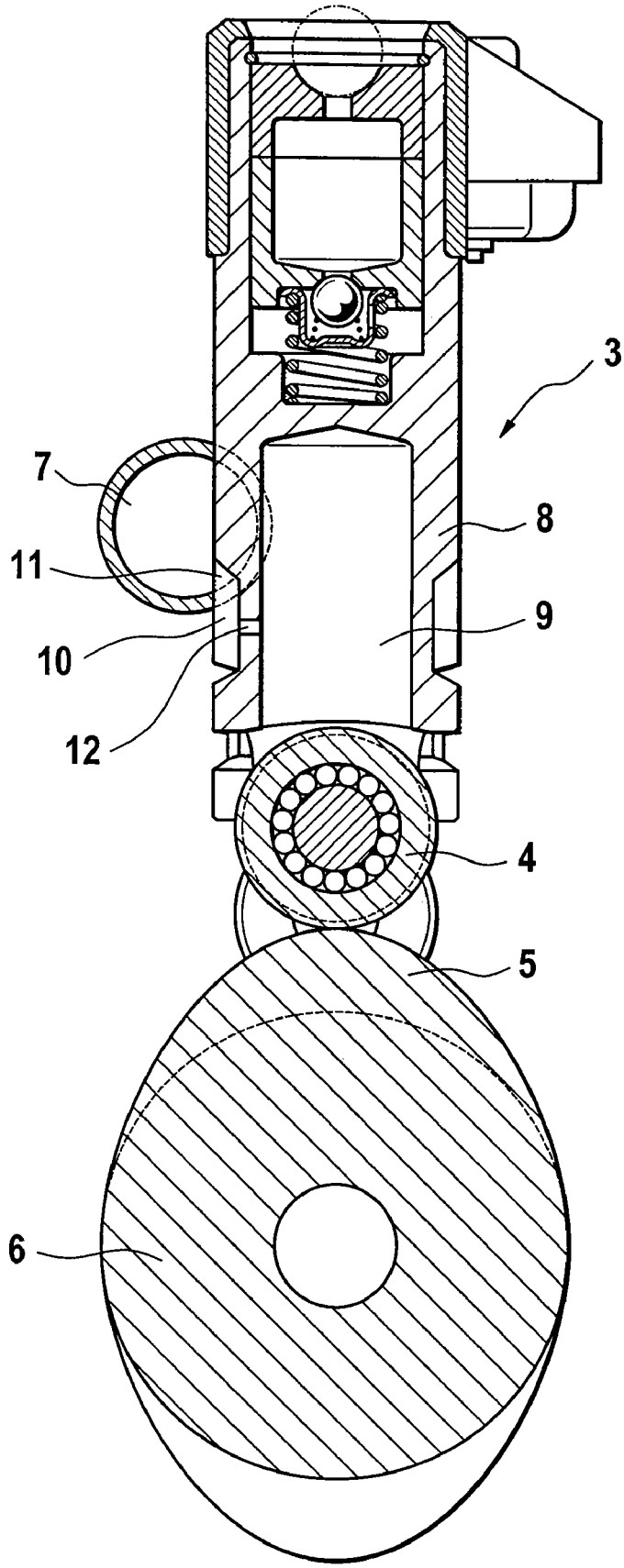
FIG. 4 shows the valve drive element according to FIG. 3 in an enlarged illustration.

As shown in FIG. 4, the valve drive element 3 contains a valve tappet 8 having an internal space 9. A longitudinal groove 10 has an upper end embodied as an overflow point 11 and is located on a circumferential point on the outer face of the valve tappet 8. The overflow point 11 extends into the switching duct 7 when the valve tappet 8 is located with its roller 4 on the cam 5 then in the upper dead center position. At this moment, it is possible for air and/or foamed hydraulic oil to flow to the overflow point 11 and from there on into the longitudinal groove 10. The air and/or the foamed hydraulic oil can then pass into the internal space 9 via a scavenging duct 12 according to the invention, which is formed as a radial bore on the valve tappet 8, in the region of the longitudinal groove 10. The scavenging duct 12 therefore has a connection to the switching duct 7 "on the stroke".

Other structural arrangements of, for example, the scavenging duct 12 and the overflow point 11 are also conceivable. The connection to the scavenging duct 12 may be configured in such a way that it is produced only in the stroke phase or else during the stroke phase and the base circle phase. The scavenging duct 12 may be of varied geometric design but should be such that the switching pressure is not reduced or is reduced only insignificantly, specifically under all the peripheral conditions such as are determined, for example, by the temperature or the oil pressure. With the embodiment according to the invention it is possible for oil also to be directed to highly stressed contacts for the purpose of lubrication and cooling.

Figure 3:
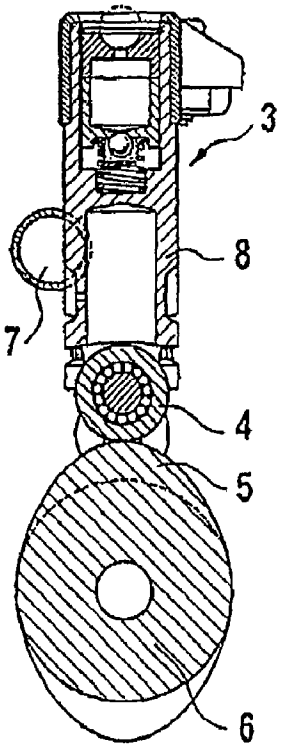
FIG. 3 shows a further drive element which is supported on the camshaft, in a longitudinal section along line III-III in FIG. 1.
Figure 2:
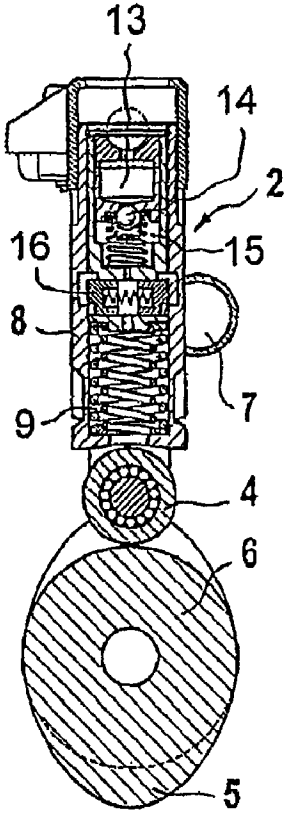
FIG. 2 shows a valve drive element which is supported on a camshaft, in a longitudinal section along line II-II in FIG. 1.

As illustrated in FIG. 2, in a preferred embodiment, the valve tappet 8 includes oil reservoir 13, ball valve 14, high-pressure space 15, connecting element 16, additional internal space 9 and roller 4 arranged in a row extending in the axial direction.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A valve drive element for an internal combustion engine, comprising a valve tappet which can be displaced axially in a bore of a machine housing, a camshaft with a respective rotatable cam thereon for operating the tappet, wherein the valve drive element is a switchable valve drive element that is actuated hydraulically, the valve tappet including an oil reservoir, a ball valve, a high-pressure space, at least one connecting element, an additional internal space, and a roller which are arranged in a row extending in an axial direction;

a switching duct which adjoins the valve tappet and is for holding a hydraulic oil, and a connection through the valve tappet between the switching duct and the additional internal space having a lower pressure level as compared to a pressure level in the switching duct, the connection comprising a longitudinal groove arranged on a lateral surface of the valve tappet and connected to the additional internal space of the valve tappet; and a scavenging duct for connecting the longitudinal groove to the additional internal space of the valve tappet, the additional internal space located between the connecting element and the roller.

2. The valve drive element as claimed in claim 1, wherein the connection further comprises a radial bore through the tappet between the outer face and the internal space.

3. The valve drive element as claimed in claim 1, further comprising an overflow point of the radial groove which permits air and/or foamed hydraulic oil to flow out of the switching duct.

4. The valve drive element as claimed in claim 3, wherein the overflow point is formed at one end of the longitudinal groove.

* * * * *